US009803473B2

(12) United States Patent
Orban et al.

(10) Patent No.: US 9,803,473 B2
(45) Date of Patent: Oct. 31, 2017

(54) DOWNHOLE ELECTROMAGNETIC TELEMETRY RECEIVER

(71) Applicant: Schlumberger Technology Corporation, Sugar Land, TX (US)

(72) Inventors: Jacques Orban, Katy, TX (US); Richard John Harmer, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/974,882

(22) Filed: Dec. 18, 2015

(65) Prior Publication Data

US 2017/0114632 A1 Apr. 27, 2017

Related U.S. Application Data

(60) Provisional application No. 62/245,741, filed on Oct. 23, 2015.

(51) Int. Cl.
*E21B 47/12* (2012.01)
*E21B 49/00* (2006.01)

(52) U.S. Cl.
CPC ..... *E21B 47/122* (2013.01); *E21B 49/00* (2013.01)

(58) Field of Classification Search
CPC ..... E21B 47/122; E21B 49/00
See application file for complete search history.

(56) References Cited

U.S. PATENT DOCUMENTS

| | | | |
|---|---|---|---|
| 4,302,757 | A | 11/1981 | Still |
| 4,372,398 | A | 2/1983 | Kuckes |
| 4,443,762 | A | 4/1984 | Kuckes |
| 4,529,939 | A | 7/1985 | Kuckes |
| 4,593,770 | A | 6/1986 | Hoehn, Jr. |
| 4,641,318 | A | 2/1987 | Addeo |
| 4,642,800 | A | 2/1987 | Umeda |
| 4,700,142 | A | 10/1987 | Kuckes |
| 4,791,373 | A | 12/1988 | Kuckes |

(Continued)

FOREIGN PATENT DOCUMENTS

| | | |
|---|---|---|
| CA | 2476370 | 1/2005 |
| EP | 0964134 B1 | 8/2003 |

(Continued)

*Primary Examiner* — Leon Flores
(74) *Attorney, Agent, or Firm* — Rachel E. Greene

(57) ABSTRACT

A method for transmitting data from a downhole tool to a surface location includes measuring a property in a wellbore using a downhole tool in the wellbore. A casing is positioned within the wellbore, and the downhole tool is positioned below at least a portion of the casing. A digital frame is generated using the downhole tool. The digital frame includes information corresponding to the property. The digital frame is encoded to superpose the information on a carrier signal. The carrier signal is converted to a voltage differential that is generated across an insulation layer in the downhole tool. The voltage differential causes a current to flow through a subterranean formation and into the casing above the downhole tool. A magnetic flux generated by the current flowing through the casing is detected using a sensor that is positioned at least partially within or at least partially around the casing.

25 Claims, 13 Drawing Sheets

(56) References Cited

U.S. PATENT DOCUMENTS

| | | | |
|---|---|---|---|
| 4,845,434 | A | 7/1989 | Kuckes et al. |
| 4,933,640 | A | 6/1990 | Kuckes |
| 5,074,365 | A | 12/1991 | Kuckes |
| 5,218,301 | A | 6/1993 | Kuckes |
| 5,305,212 | A | 4/1994 | Kuckes |
| 5,343,152 | A | 8/1994 | Kuckes |
| 5,485,089 | A | 1/1996 | Kuckes |
| 5,512,830 | A | 4/1996 | Kuckes |
| 5,513,710 | A | 5/1996 | Kuckes |
| 5,515,931 | A | 5/1996 | Kuckes |
| 5,589,775 | A | 12/1996 | Kuckes |
| 5,657,826 | A | 8/1997 | Kuckes |
| 5,725,059 | A | 3/1998 | Kuckes et al. |
| 5,883,516 | A | 3/1999 | Van Steenwyk et al. |
| 5,923,170 | A | 7/1999 | Kuckes |
| RE36,569 | E | 2/2000 | Kuckes |
| 6,023,658 | A | 2/2000 | Jeffryes |
| 6,657,597 | B2 | 12/2003 | Rodney et al. |
| 6,687,306 | B1 | 2/2004 | Wang et al. |
| 6,736,222 | B2 | 5/2004 | Kuckes et al. |
| 6,927,741 | B2 | 8/2005 | Brune et al. |
| 7,587,936 | B2 | 9/2009 | Han |
| 8,251,160 | B2 | 8/2012 | Gopalan et al. |
| 2002/0130663 | A1 | 9/2002 | Kuckes et al. |
| 2003/0085059 | A1 | 5/2003 | Kuckes et al. |
| 2003/0188891 | A1 | 10/2003 | Kuckes |
| 2004/0040745 | A1 | 3/2004 | Kuckes |
| 2004/0069514 | A1 | 4/2004 | Rodney et al. |
| 2004/0156264 | A1 | 8/2004 | Gardner et al. |
| 2005/0226340 | A1 | 10/2005 | Ahmed |
| 2006/0227005 | A1 | 10/2006 | Fincher et al. |
| 2006/0286931 | A1 | 12/2006 | Rhodes et al. |
| 2007/0126426 | A1* | 6/2007 | Clark ..... E21B 47/02216 324/326 |
| 2007/0247328 | A1 | 10/2007 | Petrovic et al. |
| 2007/0263488 | A1 | 11/2007 | Clark |
| 2008/0265892 | A1 | 10/2008 | Snyder et al. |
| 2009/0268034 | A1 | 10/2009 | Nowotarski et al. |
| 2010/0039286 | A1 | 2/2010 | Robbins |
| 2013/0137387 | A1 | 5/2013 | Christensen |
| 2013/0249705 | A1 | 9/2013 | Sharp et al. |
| 2015/0315905 | A1* | 11/2015 | Xu ..... E21B 47/122 340/854.6 |

FOREIGN PATENT DOCUMENTS

| | | |
|---|---|---|
| WO | 2004005966 | 1/2004 |
| WO | 2006023012 | 3/2006 |
| WO | 2014075190 A1 | 5/2014 |

* cited by examiner

DOWNHOLE ELECTROMAGNETIC TELEMETRY RECEIVER

CROSS-REFERENCE TO RELATED APPLICATION

This application claims priority to U.S. Provisional Patent Application having Ser. No. 62/245,741, filed on Oct. 23, 2015. The entirety of this priority provisional patent application is incorporated by reference herein.

BACKGROUND

Downhole measurement-while-drilling ("MWD") tools that transmit data uphole using electromagnetic ("EMAG") telemetry include an electrical insulation layer (e.g., ceramic, hard plastic, rubber) positioned between an upper portion of the tool and a lower portion of the tool. This is typically integrated inside a permanent connection in the collar. To transmit the data stream from within a wellbore to a surface location, a coding method is used: typically, a predetermined carrier frequency is selected and a PSK or QPSK coding is superposed to define the bit pattern. This coded signal is applied as a voltage differential between the upper and lower portions of the tool. Due to the voltage differential, current is generated that travels through the subterranean formation. More particularly, the current travels from the lower portion of the tool, out into the subterranean formation, and bends back toward the upper portion of the tool, in an almost semi-elliptical shape. The current collected by the upper portion returns towards the lower portion by flowing downward through the conductive material of the upper portion.

To receive the signal at surface, two metallic stakes are driven into the subterranean formation at the surface location. When some of the current reaches the stakes, a voltage differential is generated between the stakes, as the surface formation has some electrical resistivity. The voltage differential is applied onto the acquisition system of the surface computer so that a computer system can decode the voltage differential to recover the data stream that was transmitted from the downhole tool in the wellbore. Sometimes, however, the subterranean formation may include one or more layers having a very high resistivity or a very low resistivity that may strongly limit the current from passing therethrough and reaching the stakes. As a result, the signal (e.g., the voltage differential) may be too weak at the surface stakes and the data may not be recovered at the surface location.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A method for transmitting data from a downhole tool to a surface location is disclosed. The method includes measuring a property in a wellbore using a downhole tool in the wellbore. A casing is positioned within the wellbore, and the downhole tool is positioned below at least a portion of the casing. A digital frame is generated using the downhole tool. The digital frame includes information corresponding to the property. The digital frame is encoded to superpose the information on a carrier signal. The carrier signal is converted to a voltage differential that is generated across an insulation layer in the downhole tool. The voltage differential causes a current to flow through a subterranean formation and into the casing above the downhole tool. A magnetic flux generated by the current flowing through the casing is detected using a sensor that is positioned at least partially within or at least partially around the casing.

In another embodiment, the method includes running a downhole tool into a first wellbore. A property is measured using the downhole tool in the first wellbore. A digital frame is generated using the downhole tool. The digital frame includes information corresponding to the property. The digital frame is encoded to superpose the information on a carrier signal. The carrier signal is converted to a voltage differential that is generated across an insulation layer in the downhole tool. The voltage differential causes a current to flow through a subterranean formation and into a casing in a second wellbore. A magnetic flux generated by the current flowing through the casing in the second wellbore is detected using a sensor that is positioned in a bore defined by the casing, in the casing, in a casing shoe that is coupled to the casing, outside of the casing, or outside of the casing shoe.

In another embodiment, the method includes running a downhole tool into a first wellbore. A property is measured using the downhole tool in the first wellbore. A digital frame is generated using the downhole tool. The digital frame includes information corresponding to the property. The digital frame is encoded to superpose the information on a carrier signal. The carrier signal is converted to a voltage differential that is generated across an insulation layer in the downhole tool. The voltage differential causes a current to flow through a subterranean formation. A magnetic flux generated by the current is detected using a sensor that is positioned in a second wellbore that deviates from the first wellbore.

In another embodiment, the method includes running a downhole tool into a first wellbore having a first casing positioned therein. A property is measured using the downhole tool in the first wellbore. A digital frame is generated using the downhole tool. The digital frame includes information corresponding to the property. The digital frame is encoded to superpose the information on a carrier signal. The carrier signal is converted to a voltage differential that is generated across an insulation layer in the downhole tool. The voltage differential causes a current to flow through a subterranean formation and into a second casing in a second wellbore. A magnetic flux generated by the current flowing through the second casing is detected using a sensor that is positioned at least partially within or at least partially around the second casing. Data detected by the sensor is transmitted to a receiver positioned in or around the first casing in the first wellbore. The data from the receiver is transmitted to a computer at a surface location using a cable positioned radially-outward from the first casing in the first wellbore.

A system for transmitting data from a downhole tool in a wellbore to a surface location is also disclosed. The system includes a downhole tool that measures a property in a wellbore, generates a digital frame including information corresponding to the property, and encodes the digital frame to superpose the information on a carrier signal. The carrier signal is converted to a voltage differential that is generated across an insulation layer in the downhole tool. The voltage differential causes a current to flow through a subterranean formation and into a casing above the downhole tool. A sensor is positioned at least partially within or at least partially around the casing. The sensor detects a magnetic flux generated by the current flowing through the casing.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both, objects or steps, respectively, but they are not to be considered the same object or step.

The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

Figure 1:
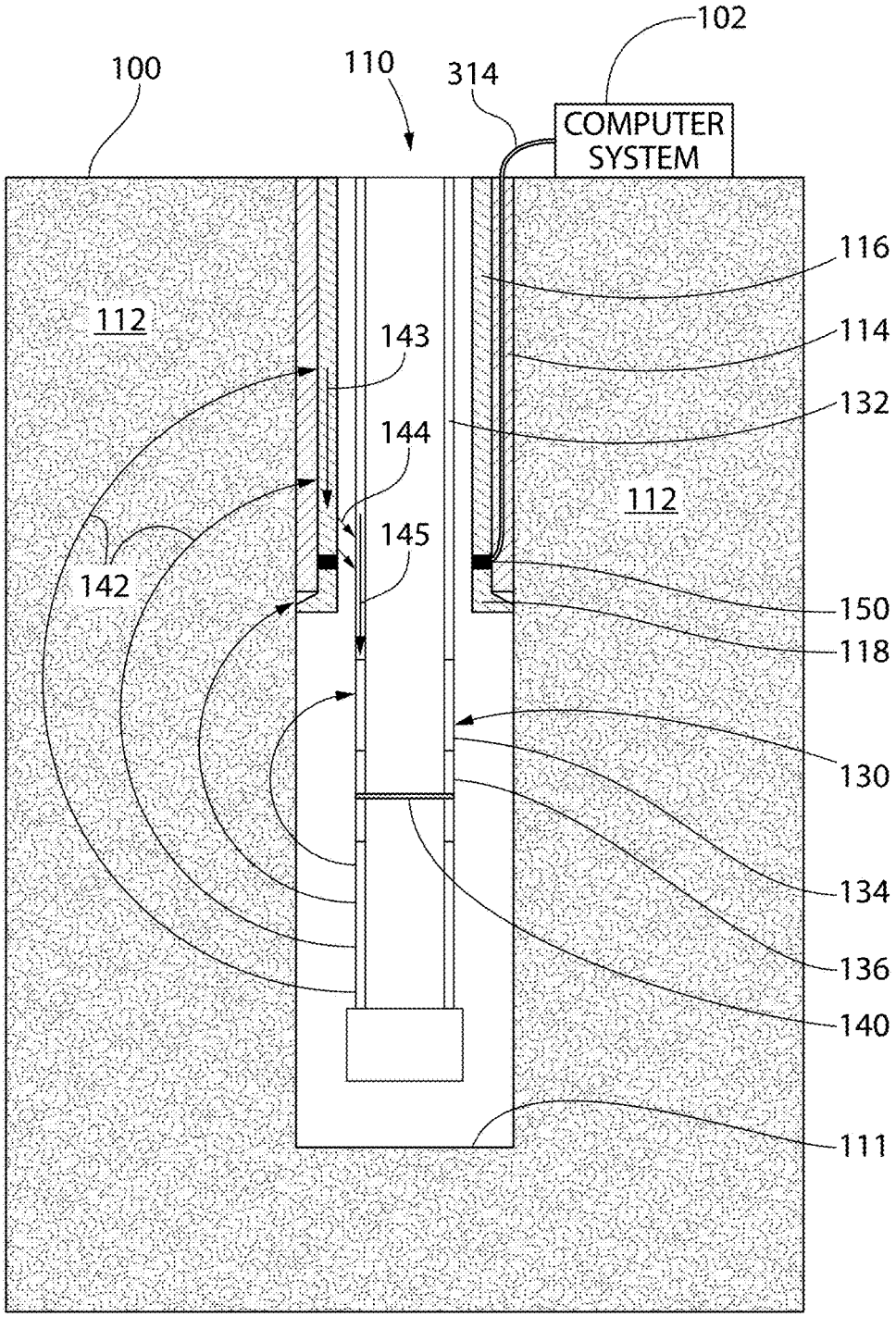
FIG. 1 illustrates a cross-sectional view of a downhole tool and a sensor positioned in a wellbore, according to an embodiment.

FIG. 1 illustrates a cross-sectional view of a wellbore 110 having a downhole tool 130 and a sensor 150 positioned therein, according to an embodiment. The wellbore 110 may be drilled in a subterranean formation 112. A casing 116 may be positioned radially-inward from the wall of the wellbore 110. A layer of cement 114 may be positioned radially-between the casing 116 and the wall of the wellbore 110 to secure the casing 116 in place. As shown, the casing 116 extends downward from a surface location 100 to a point between the surface location 100 and a base 111 of the wellbore 110. A casing shoe 118 may be coupled to a lower end of the casing 116.

The downhole tool 130 may be lowered into the wellbore 110 using a drill string 132. The downhole tool 130 may include a logging-while-drilling ("LWD") tool 134 and/or a measurement-while-drilling ("MWD") tool 136. The LWD tool 134 may be configured to measure one or more formation properties and/or physical properties as the wellbore 110 is being drilled or at any time thereafter. The MWD tool 136 may be configured to measure one or more physical properties as the wellbore 110 is being drilled or at any time thereafter. The formation properties may include resistivity, density, porosity, sonic velocity, gamma rays, and the like. The physical properties may include pressure, temperature, wellbore caliper, wellbore trajectory, a weight-on-bit, torque-on-bit, vibration, shock, stick slip, and the like. The LWD tool 134 passes its measurements to the MWD tool 136. The MWD tool 136 may then group the sets of data from itself and the LWD tool 134 and prepare the data stream for transmission to the surface location 100 after proper encoding.

The downhole tool 130 may also include an electrical insulation layer 140 positioned between an upper portion of the downhole tool 130 and a lower portion of the downhole tool 130. The insulation layer 140 may be positioned within the LWD tool 134, within the MWD tool 136, or elsewhere in the downhole tool 130. In one embodiment, the upper portion of the downhole tool 130 may be engaged with the lower portion of the downhole tool 130 via a threaded connection, and the insulation layer 140 may be a coating on the surfaces of the threaded connection, the outer surface of the downhole tool 130 proximate to the threaded connection, the inner surface of the downhole tool 130 proximate to the threaded connection, or a combination thereof. The insulation layer 140 may be or include plastic, rubber, ceramic, fiberglass, or a combination thereof.

The downhole tool 130 may transmit data (e.g., formation properties, physical properties, etc.) from within the wellbore 110 up to a computer system 102 at the surface location 100 using electromagnetic telemetry. To transmit the digital data stream from within the wellbore 110 to the surface location 100, a coding method is used. More particularly, a predetermined carrier frequency is selected, and a PSK or QPSK coding is superposed to define the bit pattern. This coded signal is applied as a voltage differential between the upper and lower portions of the downhole tool 130 across the insulation layer 140. Due to the voltage differential between the lower portion and upper portion of the downhole tool 130, current 142 is generated that travels through the subterranean formation 112. The current 142 travels from the lower portion of the downhole tool 130, out into the subterranean formation 112, and bends back toward the upper portion of the downhole tool 130, in an almost semi-elliptical shape. The current 142 collected by the upper portion returns towards the lower portion by flowing downward through the conductive material of the upper portion of the downhole tool 130.

The downhole tool 130 may apply a current of constant amplitude, while the voltage may be adjusted versus the apparent resistance of the subterranean formation 112. At least a portion of the current 142 may flow from the subterranean formation 112 into the casing 116. This portion of the current may then flow downward through the casing 116, as shown by arrow 143. At least a portion of the current 142 may flow from the casing 116 to the drill sting 132 inside the casing 116, as shown by arrows 144. This portion of the current may then flow downward through the drill string 132, as shown by arrow 145.

One or more sensors (one is shown: 150) may be positioned in the wellbore 110. More particularly, the sensor 150 may be at least partially positioned within or on the external surface of the casing 116 or the casing shoe 118. In another embodiment, the sensor 150 may be positioned radially-outward from, and axially-aligned with, the casing 116 or the casing shoe 118. The sensor 150 may be an electromagnetic receiver. The sensor 150 may communicate the detected information to the surface system via a cable or wire 314

Figure 2:
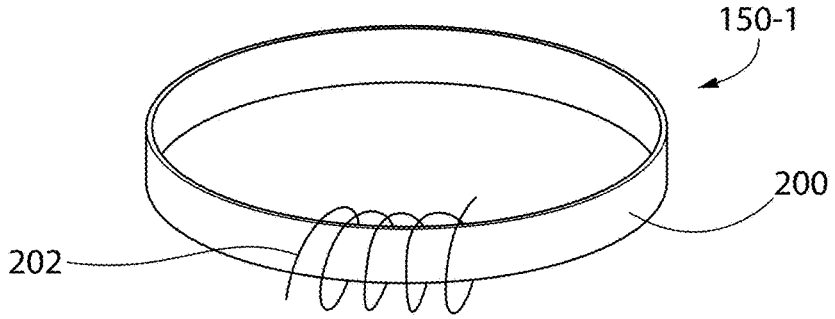
FIG. 2 illustrates a perspective view of a first embodiment of the sensor ("the first sensor), according to an embodiment.

FIG. 2 illustrates a first embodiment of the sensor 150 shown in FIG. 1 (referred to herein as the "first sensor 150-1"), according to an embodiment. The first sensor 150-1 may include an annular body (i.e., a ring or toroid) 200 of ferromagnetic laminated material. As discussed above, the body 200 may be positioned within or around at least a portion of the casing 116 or the casing shoe 118. The ferromagnetic may be or include, for example, cobalt, iron, iron oxide, or a combination thereof. However, other ferromagnetic materials are also contemplated herein.

A wire 202 may be wrapped around at least a portion of the circumference of the body 200. The wire 202 may be used to measure the magnetic flux generated into the annular body 200 by the current flowing through the casing 116, the casing shoe 118, the drill string 132, or a combination thereof. The magnetic flux measurement may be proportional to the total current flowing through the casing 116, the casing shoe 118, the drill string 132, or a combination thereof at this axial position. The measurement proportionality between the extremities of the wire 202 may depend at least partially upon the number of turns of the wire 202 around the body 200. At least a portion of the body 200 and the wire 202 may be surrounded by a deformable insulator (not shown). The insulator may be made of, for example, plastic or rubber.

As discussed in more detail below, a processor of a downhole data re-transmitter 320 (see FIG. 3) may be able to process the output of the sensor 150-1, which detects the magnetic flux, to recover the AC signal in the bandwidth used by the downhole 130 to transmit the signal via the insulation layer 140. The processor of the downhole data re-transmitter 320 may also be able to decode the digital signal by applying the inverse process for PSK or QPSK decoding. The processor may also verify the validity of the digital frame, by verifying frame elements such as the frame identifier, the checksum, the number of bits. Then, the processor of the downhole data re-transmitter 320 may re-transmit the frame towards the surface computer 102. The frame may be identical to the received frame or modified to add complementary information from the processor of the downhole data re-transmitter 320. Then, the downhole electronics may ensure the coding (e.g., PSK or QPSK) adapts the signal to the cable 314 which ensures the link to the surface system driven by the surface computer 102. From this, the computer system 102 may be able to decode the data (e.g., formation properties, physical properties, etc.).

Figure 3:
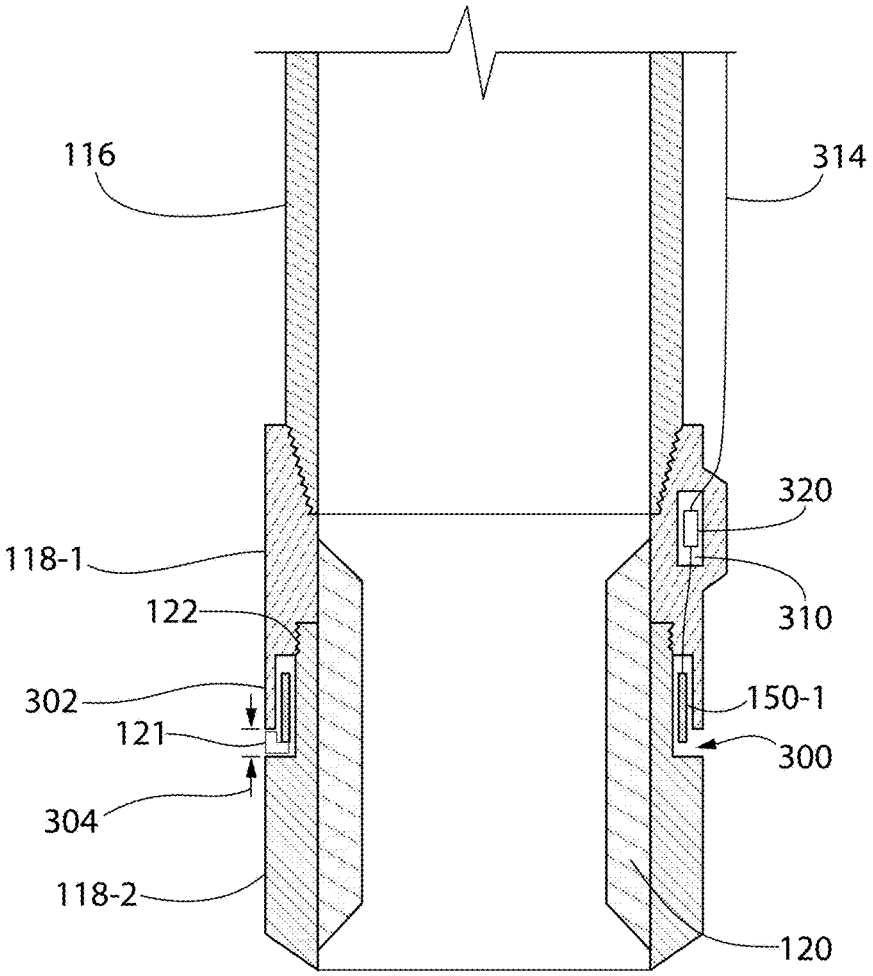
FIGS. 3-5 illustrate cross-sectional views of the first sensor positioned at least partially within a casing shoe in the wellbore, according to an embodiment.
Figure 4:
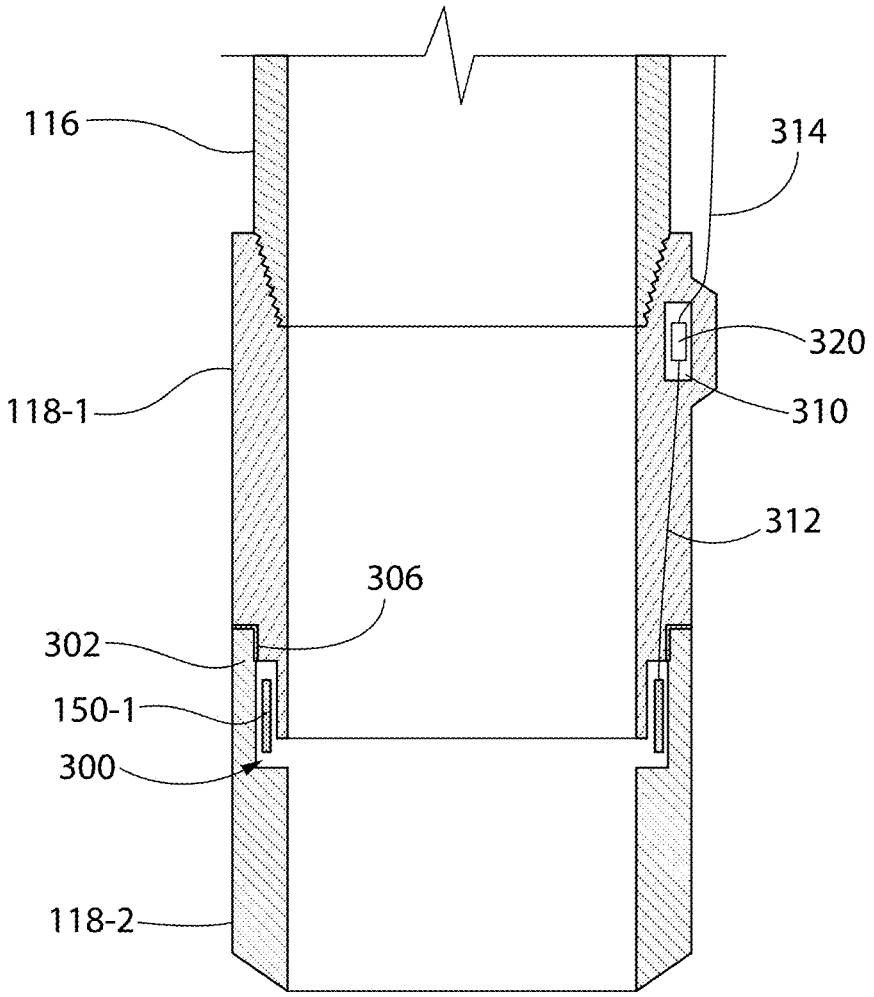
Figure 5:
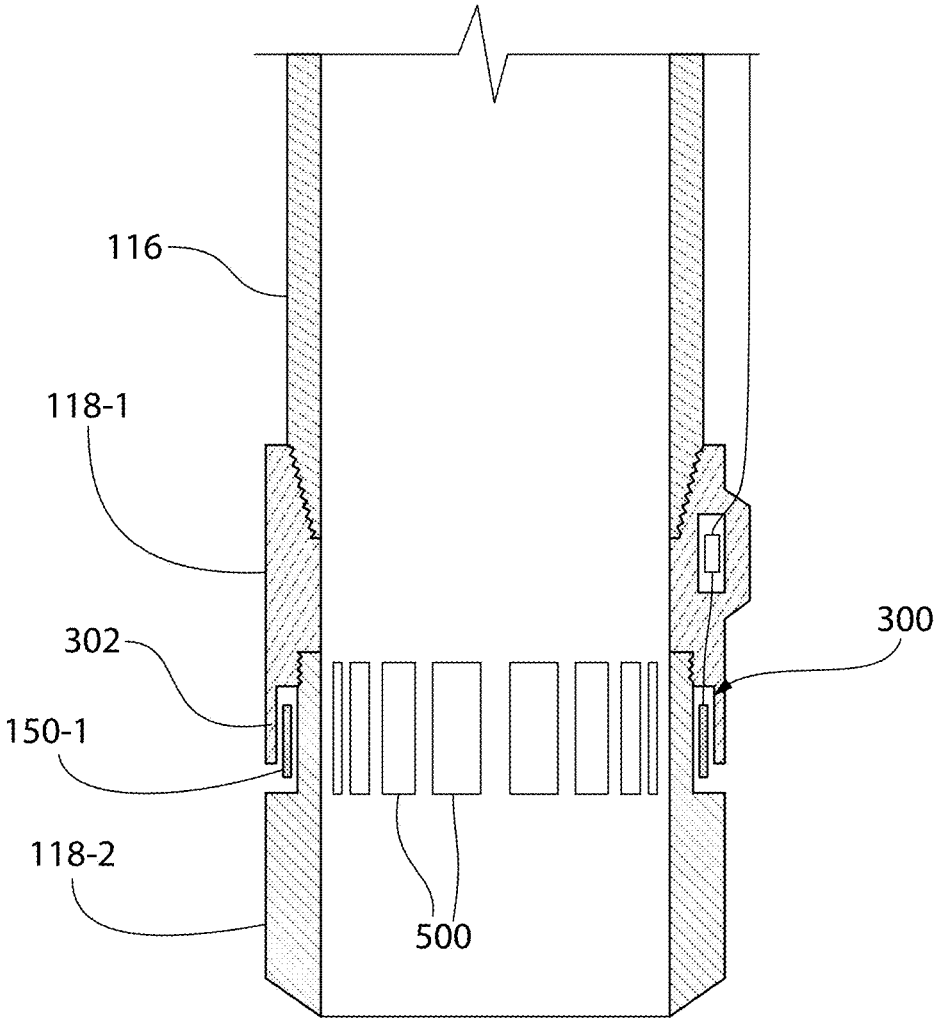

FIGS. 3-5 illustrate the first sensor 150-1 positioned at least partially within the casing shoe 118, according to an embodiment. The casing shoe 118 may include a first, upper portion 118-1 and a second, lower portion 118-2. The upper portion of the casing 118-1 shoe may be coupled to the lower end of the casing 116 via a first threaded connection, and the upper portion of the casing shoe 118-1 may be coupled to the lower portion of the casing shoe 118-2 via a second threaded connection. In another embodiment, the upper portion of the casing shoe 118-1 may be coupled to the lower portion of the casing shoe 118-2 via tight fit (such as in the area 306 around the isolator material of FIG. 4).

Drillable material 120 may be present in the bore of the casing shoe 118. Such material may be metallic (e.g., aluminum). The drillable material 120 may facilitate the guidance into the wellbore 110 (e.g., while running the casing 116 into the wellbore 110). Such drillable material 120 may be initially present in the casing shoe 118 of FIGS. 4 and 5.

A first pocket 300 may be disposed at least partially within the casing shoe 118. As shown, the first pocket 300 may be positioned between the upper and lower portions of the casing shoe 118-1, 118-2. Although not shown, in other embodiments, the first pocket 300 may be defined within the casing 116 or defined between the casing 116 and the upper portion of the casing shoe 118-1. The first sensor 150-1 may be positioned at least partially within the first pocket 300. The space in the pocket 300 surrounding the sensor 150-1 and the upper and lower portions of the casing 118-1, 118-2 may be filled with a filler element 121 which is not conductive. The filler element 121 may be a soft and formable material such as rubber or soft plastic. This filler element 121 may protect the sensor 150-1 from the fluid in the wellbore 110. The filler element 121 may surround the sensor 150-1.

As shown in FIG. 3, the upper portion of the casing shoe 118-1 may include an axial protrusion 302 that extends downwardly therefrom that defines the outer radial wall of the first pocket 300. A gap 304 may exist between the protrusion 302 and the lower portion of the casing shoe 118-2. As shown in FIG. 4, in another embodiment, the axial protrusion 302 may be part of the lower portion of the casing shoe 118-2 and extend upwardly therefrom to define the outer radial wall of the first pocket 300. In this embodiment, an insulating insert 306 may be positioned between the upper and lower portions of the casing shoe 118-1, 118-2. The gap 304 may be present at the inner surface. An isolative insert 306 may prevent the current from flowing downward through a path in the casing shoe 118 that is radially-outside of the first pocket 300. The current may instead flow downward through a path in the casing shoe 118 that is radially-inward from the first pocket 300 or inside the drill-string 132. With such design, the current 143 (see FIG. 1) flowing downwards in the casing 116 may switch/pass over into the drill string 132 as current 145 via the leakage current 144. This this switching may mostly occur above the sensor 150-1.

The first sensor 150-1 may be configured to measure magnetic flux generated by the current 143, 145 that flows through the path that is radially-inward from the first sensor 150-1. Although not shown, in some embodiments, the gap 304 may not be present between the upper and lower portions of the casing shoe 118-1 and 118-2. Rather, inner surfaces of the upper and lower portions of the casing shoe 118-1 and 118-2 may be in contact with one another. This overlap may be tight fit or equipped with a thread to hold the upper and lower portions of the casing shoe 118-1 and 118-2 together. In embodiments such as the one shown in FIG. 4, the insulating insert 306 may be electrically-isolative. The isolation may be obtained by a glass or ceramic coating in the overlap area. In other embodiments, plastic or rubber may be used.

In at least one embodiment, a second pocket 310 may be formed in the casing 116 or the casing shoe 118. The second pocket 310 may be positioned slightly above (i.e., closer to the origination point of the wellbore 110) than the first pocket 300. The second pocket 310 may extend axially and may be included in one blade of a local upset acting as stabilizer blade. As shown, the second pocket 310 may be formed in the upper portion of the casing shoe 118-1. At least a portion of downhole data re-transmitter 320 may be positioned within the second pocket 310. One or more cables or wires 312 (FIG. 4) may be coupled to and extend between the first sensor 150-1 in the first pocket 300 and the downhole data re-transmitter 320 in the second pocket 310. The cable 312 may transmit the signal (current) proportional to the magnetic flux measurement to the downhole data re-transmitter 320 in the second pocket 310.

The downhole data re-transmitter 320 in the second pocket 310 may include a power supply or regulator that is configured to provide the power to the other electrical components in the second pocket 310. The power may be provided by a battery or by a cable or wire that extends downward from a power source at the surface location 100. The downhole data re-transmitter 320 in the second pocket 310 may also include a digital unit with a processor (CPU) and memory to control the data acquisition from the sensor 150-1 in the first pocket 300. The digital unit may also format the data in the measurement into a telemetry frame that is to be transmitted to the surface location 100, as discussed in more detail below. The memory may include software, calibration information for the sensor 150-1, etc. In some embodiments, diagnostic data may be stored in the memory for retrieval at a later time. The processor may manage the time reference for the data acquisition. The time reference may be re-synchronized versus the uphole clock of the surface computer 102. Some data may be exchanged between the surface computer 102 and the CPU of the downhole data re-transmitter 320.

The downhole data re-transmitter 320 in the second pocket 310 may also include an analog to digital converter ("ADC") configured to convert the signal in the cable 312, which is proportional to the magnetic flux measurement, into digital data stream. In some embodiments, an analog filter may be positioned between the sensor 150-1 and the ADC to remove noise from the signal to avoid aliasing and potential ADC saturation by signals outside the frequency bandwidth of interest for the telemetry. The digital data stream may be decoded to recover the digital frame sent by the downhole tool 130. The downhole data re-transmitter 320 may also include a telemetry electronic system configured to ensure proper transmission and reception of the signal through the cable 314 to/from the computer system 102 at the surface location 100. The telemetry electronic system may be a hardwire interface between the cable 314 and the processor.

In at least one embodiment, a filter may be positioned within the cable 314 to the surface location 100 for proper superposition of power feeding and telemetry signals when a single medium is used for the two functions. The link to and from the surface location 100 may be the cable 314, while the return may be through the casing 116. The downhole data re-transmitter 320 may also include a filter between the cable 314 and the rest of electronics in the pocket 310 to recover the power provided via the cable 314 from the surface system 102, while allowing proper telemetry along the same cable 314. The telemetry may be one-way (towards the surface) or two-ways.

Referring now to FIG. 5, in at least one embodiment, the casing shoe 118 may have one or more openings 500 formed radially-therethrough. The openings 500 may have a cross-sectional shape that is rectangular, circular, or any other shape. As shown, the openings 500 may be circumferentially-offset from one another and axially-aligned with the first pocket 300 and/or the first sensor 150-1. The openings 500 may prevent (or limit) circumferential lines of high magnetic flux generated by the presence of axial current in the drill string 132. The presence of such circumferential lines of magnetic flux may reduce the sensitivity to the current flowing downwards in the drill string 132 by affecting magnetic flux detected by the sensor 150-1 (or 150-2). The openings 500 may be implemented in the design shown in FIG. 3.

Figure 6:
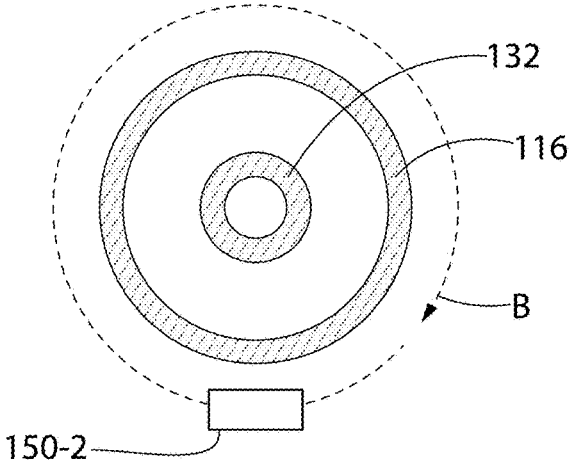
FIG. 6 illustrates a cross-sectional view of the downhole tool showing a second embodiment of the sensor ("the second sensor").
Figure 7:
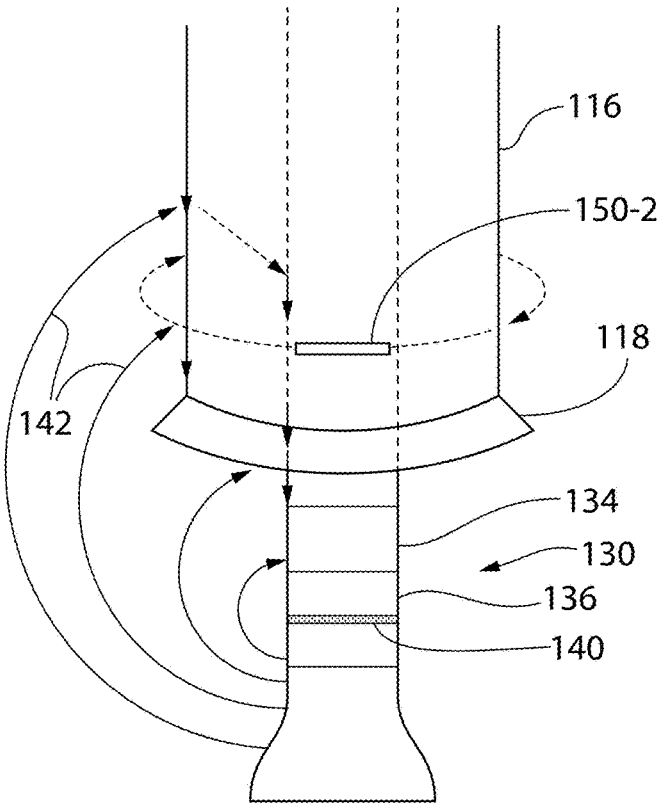
FIG. 7 illustrates a cross-sectional view of the second sensor positioned radially-outward from the casing or casing shoe in the wellbore, according to an embodiment.

FIG. 6 illustrates cross-sectional view of the well showing a second embodiment of the sensor 150 from FIG. 1 (referred to herein as the "second sensor 150-2"), and FIG. 7 illustrates a perspective view of the second sensor 150-2 positioned radially-outward from the casing 116 or the casing shoe 118, according to an embodiment. The second sensor 150-2 may be a magnetometer. The second sensor 150-2 may be positioned radially-outward from the casing 116 (e.g., from about 1 mm to about 10 cm). The second sensor 150-2 may be configured to measure the magnetic flux β generated by the current flowing downward through the casing 116, the casing shoe 118, the drill string 132, or a combination thereof. The measurement axis of the sensor 150-2 may be oriented in the tangential direction to the casing 116. The measurement may be affected by the distance between the second sensor 150-2 and the casing 116 and/or casing shoe 118. For such application, the material of the casing 116 and the casing shoe 118 in the vicinity of the depth of the second sensor 150-2 may be non-magnetic (e.g., a magnetic permeability close to unity). Such material cannot be magnetized, reducing the risk of creating DC saturation of the second sensor 150-2.

Figure 8A:
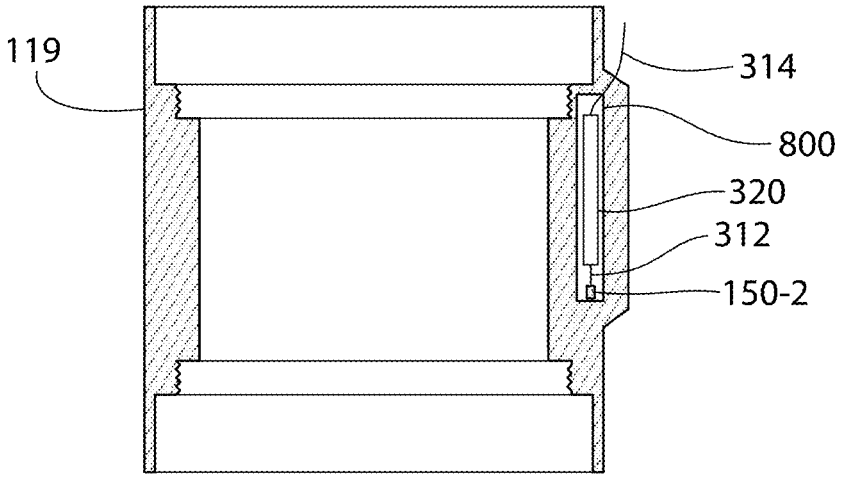
FIGS. 8A and 8B illustrate a cross-sectional side view and a cross-sectional top view of the second sensor positioned at least partially within the casing, the casing shoe, or a casing nipple, according to an embodiment.
Figure 8B:
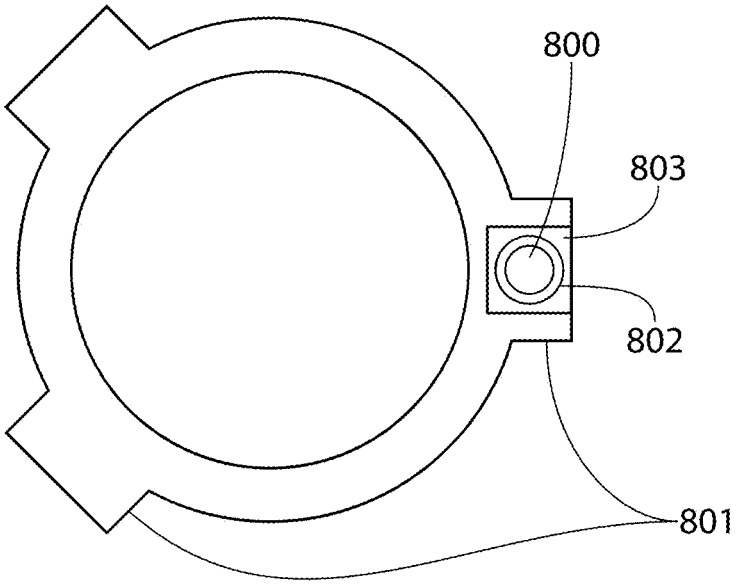

FIGS. 8A and 8B illustrate a cross-sectional side view and a cross-sectional top view of the second sensor 150-2 positioned at least partially within a casing nipple 119, according to an embodiment. As shown, a pocket 800 may be defined in the casing nipple 119. Although not shown, in another embodiment, the pocket 800 may be defined in the casing 116 or the casing shoe 118. The second sensor 150-2 may be positioned within the pocket 800. The pocket 800 may be included in one blade 801 of the integral stabilizer of the casing nipple 119. The casing nipple 119 and the housing containing the pocket 800 may be in non-magnetic steel to allow the magnetic flux generated by the current flowing in the casing 116 and the drill-string 132 to penetrate into the pocket 800 and to allow the sensor 150-2 to detect the corresponding magnetic flux. Furthermore, the pocket 800 may be included inside a small pressure housing 802 so that the downhole data re-transmitter 320 is in an atmospheric chamber. The housing 802 may be made of non-magnetic steel or any material with low magnetic permeability that is not magnetic. Illustrative materials may include plastic, rubber and ceramic. The housing 802 may be radially-outward from the casing nipple 119. It may be inserted in the recess 803 of the stabilizer blade 801. As such, most of the magnetic flux generated by the downwards flowing current in the casing 116 and drill-string 132 may be sensed by the sensor 150-2.

The downhole data re-transmitter 320 may also be positioned within the pocket 800 or pressure housing 801. The first cables 312 may be coupled to and extend between the second sensor 150-2 and the acquisition system (filter and ADC) of the downhole data re-transmitter 320 in the pocket 800. The first cables 312 may transmit the magnetic flux measurement to the downhole data re-transmitter 320 in the pocket 800. The cable 314 may then transmit the data from the downhole data re-transmitter 320 in the pocket 800 to the computer system 102 at the surface location 100. In one embodiment, the cable 314 may be combined with the casing 116 to allow the exchange of current. The casing 116 may be considered as the ground of the downhole data re-transmitter 320 and some electronics of the surface system 102. This electrical circuit including the cable 314 allows the telemetry between the downhole data re-transmitter 320 and the surface system 102. This telemetry may be either upwards telemetry or bi-directional. The surface system 102 may superpose power over the telemetry signal in the circuit including the cable 314, allowing the downhole data re-transmitter 320 to operate from this power.

Figure 9A:
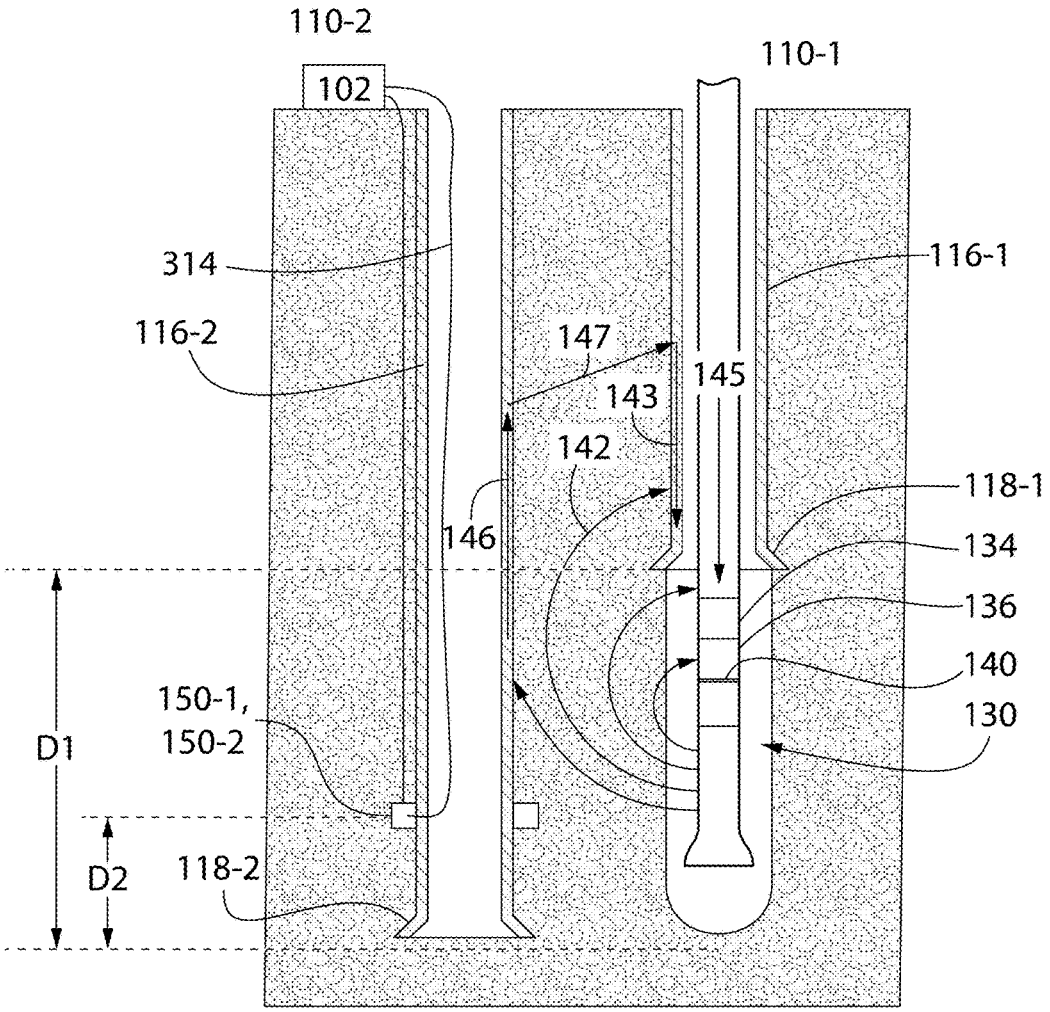
FIGS. 9A and 9B illustrate cross-sectional views of the downhole tool positioned in a first wellbore, and the first and/or second sensor positioned in a second wellbore, according to an embodiment.

FIG. 9A illustrates the downhole tool 130 positioned in a first wellbore 110-1, and the first and/or second sensor 150-1, 150-2 positioned in a second wellbore 110-2, according to an embodiment. A portion of the first wellbore 110-1 may be lined with a casing 116-1. When multiple wellbores 110-1, 110-2 are drilled in close proximity to one another, the first and/or second sensor 150-1, 150-2 may be positioned in a different wellbore than the downhole tool 130. As used herein, a "close proximity" refers to a lateral distance that is less than or equal to 50 meters.

The second wellbore 110-2 may have a casing 116-2 extend the length of the second wellbore 110-2. The first and/or second sensor 150-1, 150-2 may be at least partially positioned within or around the casing 116-2 or the casing shoe 118-2, as discussed above. At least a portion of the current 142 emitted from the downhole tool 130 in the first wellbore 110-1 may be received and flow upward through the casing 116-2 in the second wellbore 110-2. This portion of the current 146 flowing upwards in the casing 116-2 may return to the casing 116-1 as current lines 147 through the subterranean formation 112. The current may then flow downwards through the casing 116-1 and the drill string 132, as shown by lines 143 and 145, respectively, towards the gap 140.

The first and/or second sensor 150-1, 150-2 may be configured to measure the magnetic flux generated by the current flowing through the casing 116-2, the casing shoe 118-2. This data may then be transmitted up to the computer system 102 at the surface location via the cable 314 in the second wellbore 110-2. The cable 314 may be positioned inside the cement sheet surrounding the casing 116-2. The cable 314 may be inside the second wellbore. In such a case, the cable 314 may be lowered in the second wellbore 110-2 after the installation and cementing of the casing 116-2. A coupler (not shown) may allow the interconnection between the sensor 150-1, 150-2 and the cable 314. This coupler may include electronic to insure the proper interconnect and communication between the sensor and the surface system 102. In the embodiment shown in FIG. 9A, the sensor 150-1 or 150-2 in the second wellbore 110-2 may be in a casing section or casing nipple 119 installed in the casing 116-2 at such a depth so that the distance D2 is smaller than D1. D1 may represent the distance between the depth of the casing shoe 118-1 in the well 110-1 and the casing shoe 118-2 of the well 110-2. D2 may represent the distance between the sensor 150-1, 150-2 and the casing shoe 118-2 in the second wellbore 110-2. D2=Ka*D1. Ka may be from about 0.0.25 to about 1.25.

Figure 9B:
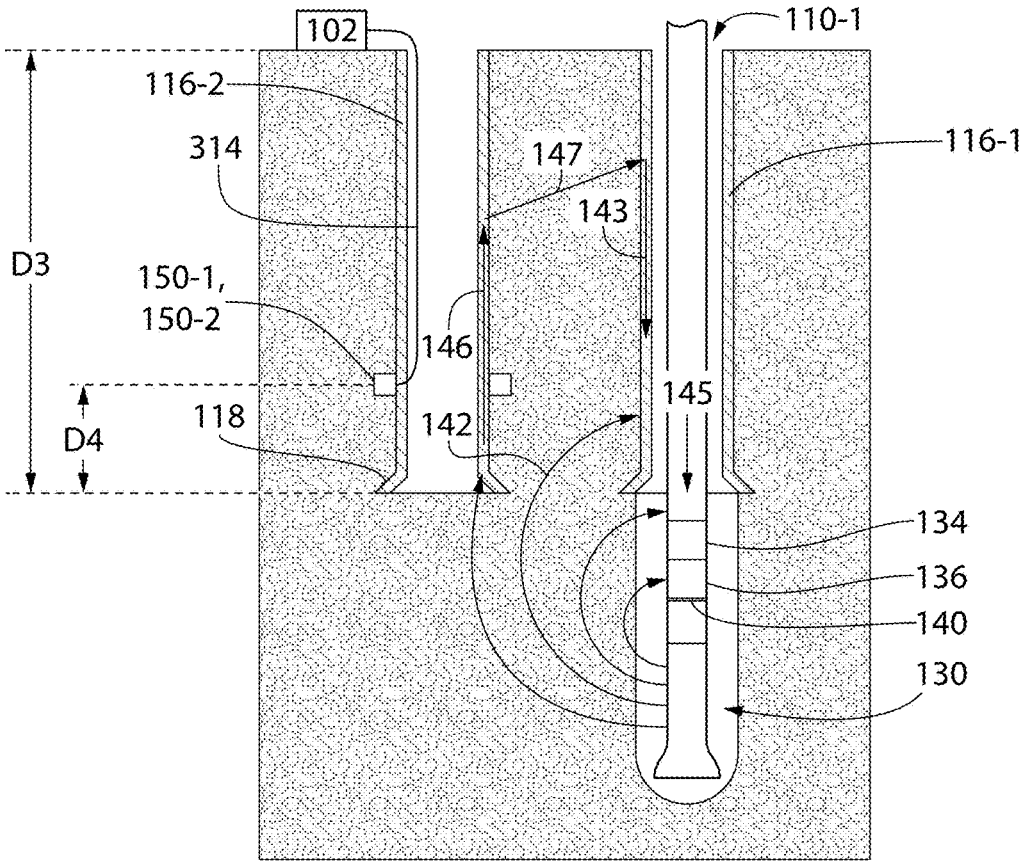

In the embodiment shown in FIG. 9B, the depth of second wellbore 110-2 is similar to the depth of the cased section 116-1 of the first wellbore 110-1. In such conditions, the sensor 150-1 and 150-2 may be installed in the second wellbore 110-2 at a distance D4 from the casing shoe 118-2 so that D4=Kb*D3. D3 may represent the distance between the surface location 100 and the bottom of the second wellbore 110-2 and/or the casing shoe 118-2. D4 may represent the distance between the sensor 150-1, 152-2 and the bottom of the second wellbore 110-2 and/or the casing shoe 118-2. Kb may be from about 0 to about 0.25.

Figure 10:
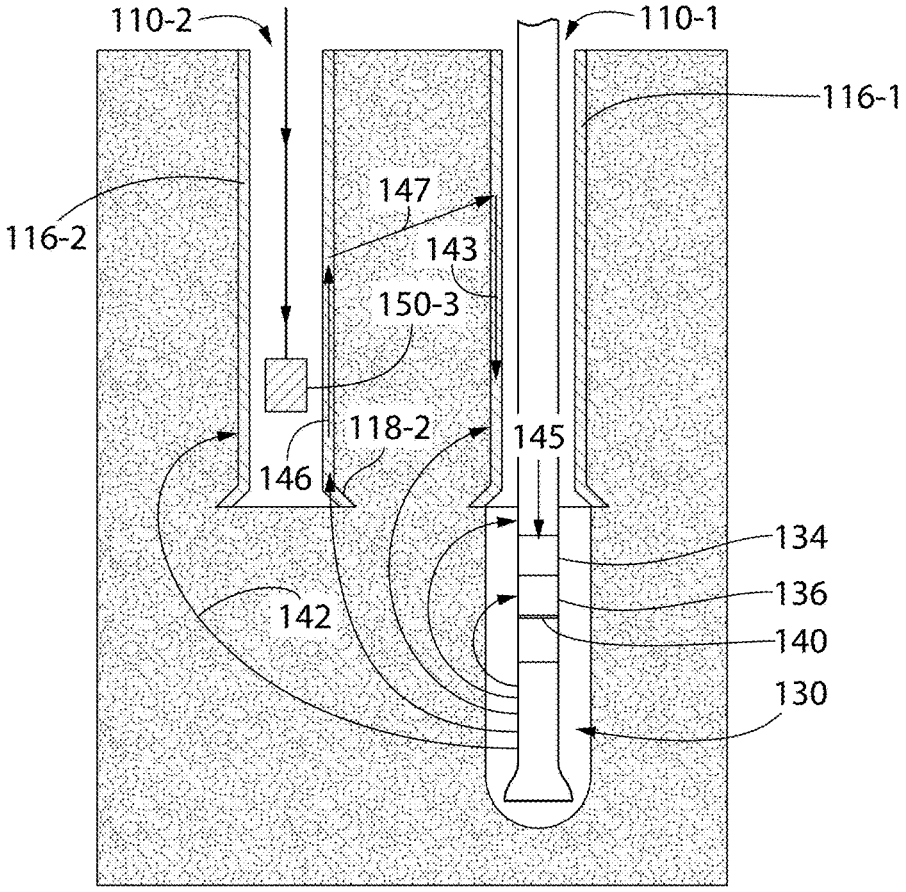
FIG. 10 illustrates a cross-sectional view of the downhole tool positioned in a first wellbore, and a third sensor positioned in a second wellbore, according to an embodiment.

FIG. 10 illustrates the downhole tool 130 positioned in the first wellbore 110-1, and a third sensor 150-3 positioned in the second wellbore 110-2, according to an embodiment. The second wellbore 110-2 may be equipped with a casing 116-2. When multiple wellbores 110-1, 110-2 are drilled in close proximity to one another, the third sensor 150-3 may be positioned in a different wellbore than the downhole tool 130. The third sensor 150-3 may be lowered into the second wellbore 110-2 on a wireline, a cable, or the like. The third sensor 150-3 may be lowered to a position in the second wellbore 110-2 that is below the origination point of the second wellbore 110-2 and above the casing shoe 118-2. For example, the third sensor 150-3 may be lowered to a position that is from about 50% to about 90% or from about 60% to about 80% of the distance from the origination point to the casing shoe 118. This may allow the third sensor 150-3 to sense the current 146 flowing through the casing 116-2 in the second wellbore 110-2 before the current jumps or returns to the casing 116-1 in the first wellbore 110-1, as shown at 147. The current 143, 145 returns through the casing 116-1 and the drill string 132 of the first wellbore 110-1 downwards towards the gap 140. In another embodiment, the third sensor 150-3 may be positioned below the casing shoe 118.

Figure 11:
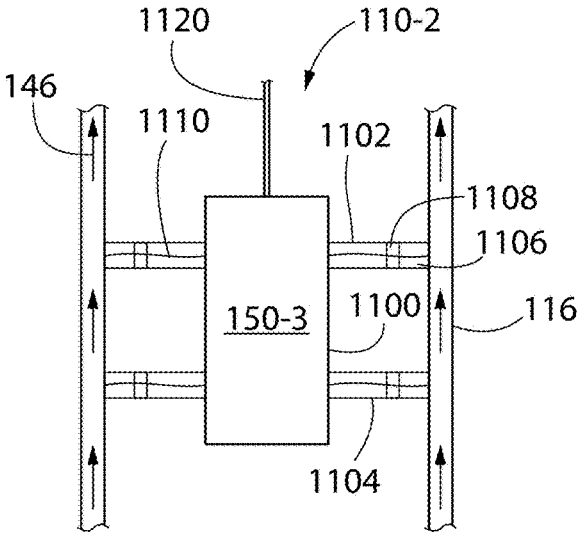
FIG. 11 illustrates an enlarged cross-sectional view of the third sensor positioned in the second wellbore, according to an embodiment.

FIG. 11 illustrates an enlarged view of the third sensor 150-3 positioned in the second wellbore 110-2, according to an embodiment. The third sensor 150-3 may be part of a wireline tool. The third sensor 150-3 may include a body 1100 having one or more first arms (two are shown: 1102) and one or more second arms (two are shown: 1104) coupled thereto. The first arms 1102 may be circumferentially-offset from one another, and the second arms 1104 may be circumferentially-offset from one another. The first arms 1102 may be axially-offset from (e.g., above) the second arms 1104. The first and second arms 1102, 1104 may be folded against the body 1100 of the third sensor 150-3 when the third sensor 150-3 is run downhole. When in the desired position, the first and second arms 1102, 1104 may be actuated radially-outward and into contact with the casing 116-2 (or casing shoe 118-2 in other embodiments).

The first and second arms 1102, 1104 may each include an electrode 1106 that is configured to be in contact with the casing 116. The first and second arms 1102, 1104 may each also include an electrical insulator 1108 positioned between the electrode 1106 and the body 1100. A wire 1110 may pass through or around the electrical insulator 1106 to transmit the local voltage from the casing 116-2 to the acquisition system of the downhole tool 130 of the third sensor 150-3. The voltage differential between the first arms 1102 and the second arms 1104 may be determined. The voltage differential may then be transmitted to the computer system 102 at the surface location 100 through the wireline or cable 1120. The voltage difference is proportional to the current 146 flowing upwards to the casing 116-2. The voltage difference has the same pattern as the voltage transmitted by the downhole tool 130 through the gap 140. Decoding of the data may be performed from this voltage pattern by the third sensor 150-3 or the surface system 102 connected to the wireline cable 1120.

Figure 12A:
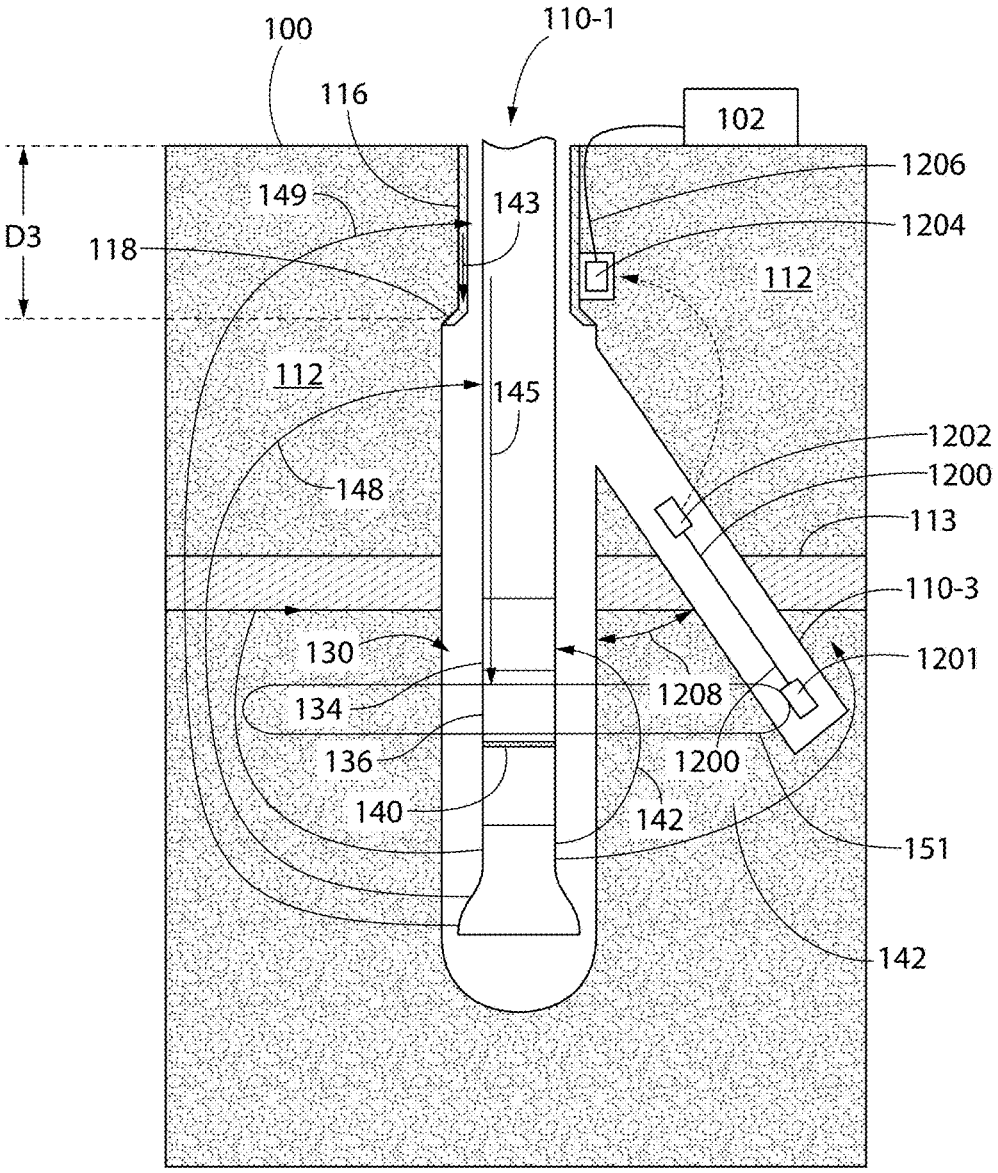
FIG. 12A illustrates a cross-sectional view of the downhole tool positioned in a first wellbore, and the second sensor positioned in a second wellbore that deviates from the first wellbore, according to an embodiment.

FIG. 12A illustrates the downhole tool 130 positioned in a first wellbore 110-1, and the second sensor 150-2 positioned in a second wellbore 110-3 that deviates from the first wellbore 110-1, according to an embodiment. The second wellbore 110-3 may deviate from the first wellbore 110-1 at a point near the casing shoe 118 of the casing 116 already installed in the first wellbore 110-1. The second wellbore 110-3 may have a smaller diameter than the first wellbore 110-1 and may be drilled from the casing shoe 118. The second wellbore 110-3 may be drilled after the casing 116 has been installed and cemented in the first wellbore 110-1 when the depth of the first wellbore 110-1 was D3. At the time of drilling the second wellbore 110-3, the first wellbore 110-1 may have the depth D3. The first and second wellbores 110-1, 110-3 may be oriented at an angle 1208 with respect to one another that is less than or equal to about 10 degrees.

A lower repeater 1201 may be positioned within the second wellbore 110-3. The lower repeater 1201 may have a cylindrical shape with its main axis parallel to the second wellbore 110-3. In at least one embodiment, the lower repeater 1201 may be positioned below a layer 113 of the subterranean formation 112 that drastically attenuates the current flowing upwards through the subterranean formation 112. The layer 113 may have a resistivity that is less than or equal to a first predetermined or greater than or equal to a second predetermined amount. The first predetermined amount may be about 1 Ωm, and the second predetermined amount may be about 1000 Ωm. Thus, the layer 113 may greatly attenuate the currents 148 and 149 emitted from the downhole tool 130 that pass through the layer 113 such that a sensor positioned above the layer 113 may not be able to sense adequately the resultant currents 143 and 145.

The lower repeater 1201 may be configured to measure the magnetic flux of the current 142. The lower repeater 1201 may be equipped with two sensors 150-2. The sensors 150-2 are installed in plane perpendicular to the repeater 1201 main axis, and also perpendicular between themselves in that plane. The sensors 150-2 sense a magnetic field line 151 generated by the current 145 flowing in the collar and some current lines 142 passing within the loop defined by the magnetic line 150. The outputs of the sensors 150-2 are summed as vector to obtain the total amplitude. This vectoral sum may be used as the output to decode the signal transmitted by the downhole tool 130 via the gap 140. From the decoded signal, the digital frame may be recovered.

This digital data may be transmitted via a cable or wire 1200 from lower repeater 1201 to an electromagnetic repeater 1202 that is positioned in the second wellbore 110-3. The electromagnetic repeater 1202 may then (e.g., wirelessly) transmit the data to an electromagnetic upper receiver 1204 that is positioned at least partially within or around the casing 116 or casing shoe 118 in the first wellbore 110-1. The data may then be transmitted from the electromagnetic upper receiver 1204 to the computer system 102 at the surface location 100 via a wire or cable 1206. The electromagnetic transmission may be based on using coiled antennas with their axes nearly parallel to the wellbore where the device is installed (e.g., the wellbore 110-3 for the electromagnetic repeater 1202 and wellbore 110-1 for the upper receiver 1204). Such coiled antennas may be similar to the antenna for an induction logging tool. The frequency may be between from about 200 Hz to about 2000 Hz.

Figure 12B:
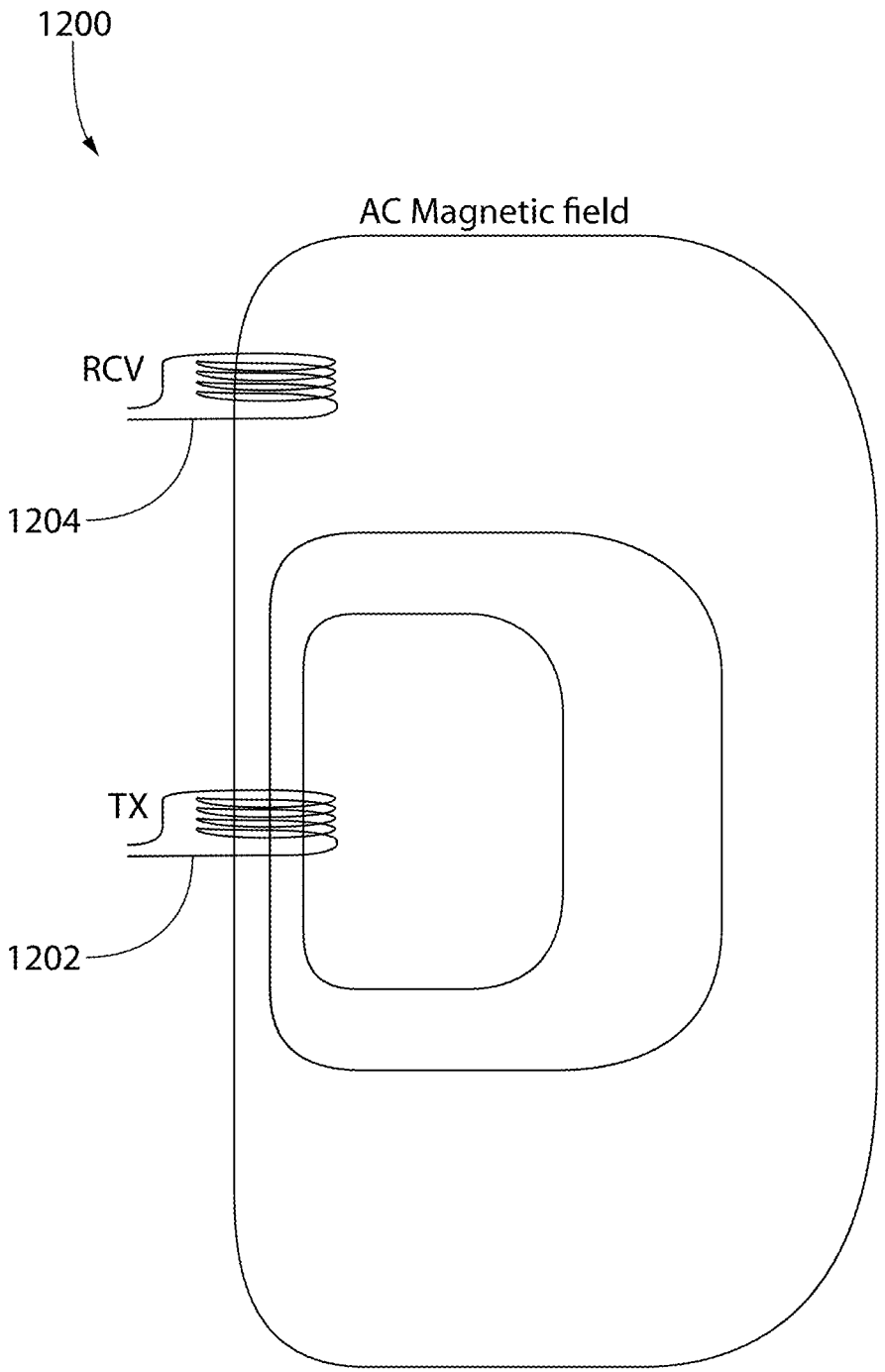
FIG. 12B illustrates an antenna and the AC magnetic flux providing the coupling between a transmitter and a receiver, according to an embodiment.

FIG. 12B illustrates an antenna 1200 and the AC magnetic flux providing the coupling between a transmitter 1202 and a receiver 1204, according to an embodiment. This coupling between the transmitter 1202 and the receiver 1204 does not rely on the presence of a metallic structure between the 2 devices. It also may have limited dependence on formation resistivity. As such, the communication system may be bidirectional.

For proper implementation in the wellbore 110-1, the wellbore 110-1 may be drilled up to the depth D3. The casing 116 may then be installed and cemented. The casing 116 includes the receiver 1204. The receiver 1204 may be installed near the casing shoe 118 or at the casing shoe 118. The cable 1206 may also be present in the cement sheet surrounding the casing 116. Then, a small drill-bit and associated drill-string may be lowered in the cased wellbore 110-1. Drilling begins starting just below the casing shoe 118. The small drill string is operated in such a way that the new wellbore 110-3 is side-tracked. The third wellbore 110-3 may not be aligned with the first wellbore 110-1. The side-tracking of the third wellbore 110-3 may be obtained by using a bend motor in sliding mode. When the third wellbore 110-3 is drilled to its depth, the small drilling system may be from the third wellbore 110-1.

Then, the repeaters 1201, 1202 with the intermediate cable 1200 may be lowered in the third wellbore 110-3. This installation of the assembly 1200, 1201, 1202 may be performed using a tubular (not shown) or a cable (not shown) and retrieved after installation. During the installation, the assembly 1200, 1201, 1202 may be held in place in the wellbore 110-3 using an anchor at the electromagnetic receiver 1202.

Cement may be injected or squeezed into the third wellbore 110-3. Then, the drilling of the first wellbore 110-1 may be started with the drilling system including the downhole tool 130.

Figure 13:
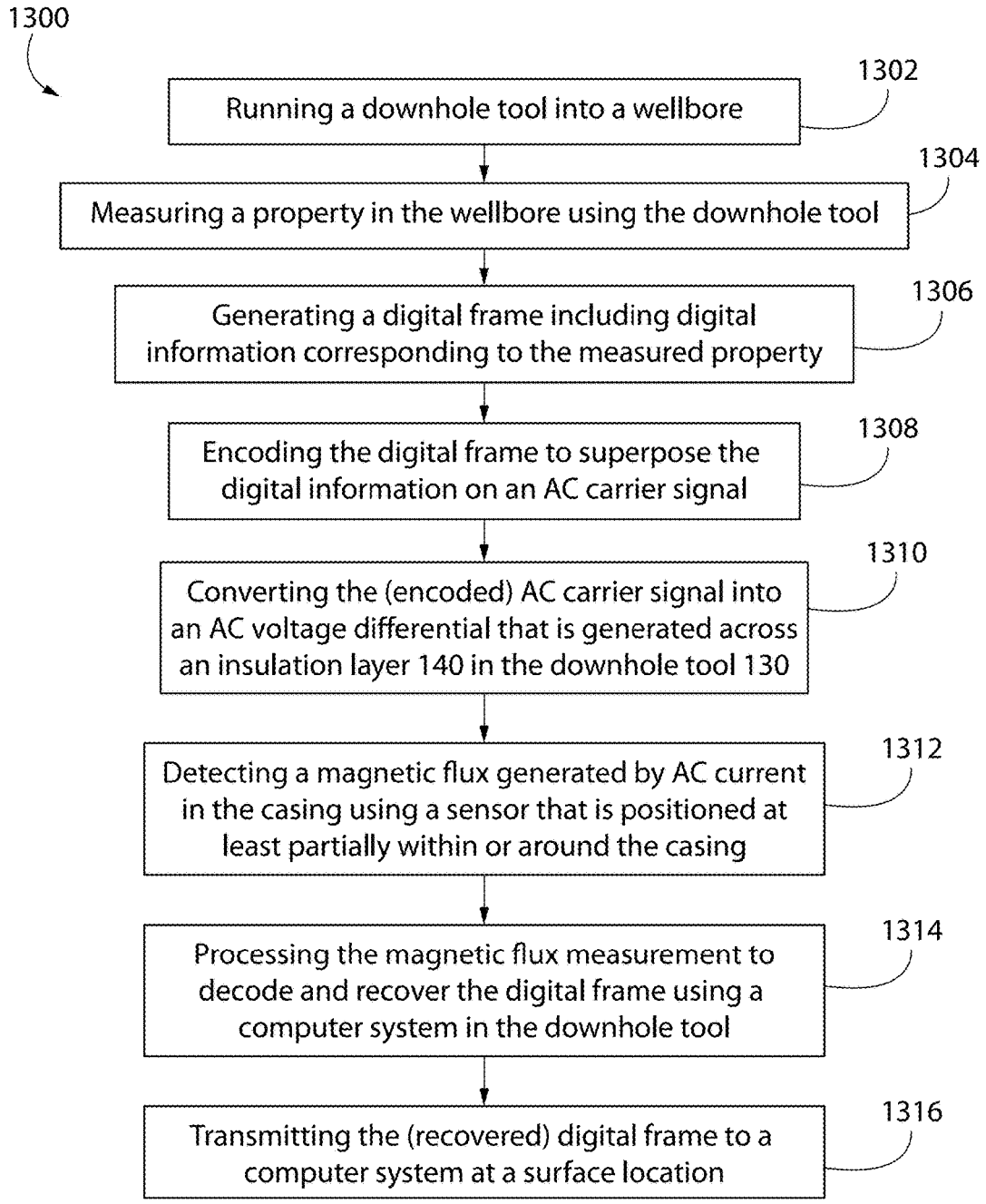
FIG. 13 illustrates a flow chart of a method for transmitting data from a downhole tool in a wellbore to a surface location using electromagnetic telemetry, according to an embodiment.

FIG. 13 illustrates a flow chart of a method 1300 for transmitting data from a downhole tool 130 in a wellbore 110 to a surface location 100 using electromagnetic telemetry, according to an embodiment. The method 1300 may be performed using any of the embodiments discussed above. The method 1300 may begin by running the downhole tool 130 into the wellbore 110, as at 1302. The wellbore 110 may have a casing 116 positioned therein. The downhole tool 130 may be positioned below at least a portion of the casing 116.

The method 1300 may then include measuring one or more properties using the downhole tool 130 (e.g., the MWD tool 134 or the LWD tool 136) once the downhole tool 130 is in the wellbore 110, as at 1304. The properties may be or include any of the physical properties or formation properties discussed above.

The method 1300 may then include the generating a digital frame including digital information corresponding to the measured properties, as well a frame identifier and frame checksum, as at 1306. The method 1300 may also include encoding the digital frame to superpose the digital information on an AC carrier signal, as at 1308. More particularly, the digital frame may be ended IE following QPSK to superpose the digital information on the AC carrier signal. The method 1300 may also include converting the encoded AC carrier signal into an AC voltage differential that is generated across an insulation layer 140 in the downhole tool 130, as at 1310. The AC voltage differential may cause AC current 142 to flow through the subterranean formation 112. At least a portion of the AC current 142 may flow into the casing 116 in the wellbore 110 that is positioned above the downhole tool 130. The AC current may then flow downward through the casing 116 toward the insulation layer 140 in the downhole tool 130. The AC current flowing through the casing 116 or the casing shoe 118 may generate an AC magnetic flux.

The method 1300 may also include detecting and measuring the AC magnetic flux generated by the AC current in the casing 116 or the casing shoe 118 using a sensor 150-1, 150-2 that is positioned at least partially within or around the casing 116 or the casing shoe 118, as at 1312. The method 1300 may then include processing the magnetic flux measurement from the sensor 150-1, 150-2 to decode and recover the digital frame using a first computer system of the downhole data re-transmitter 320, as at 1314. Processing the magnetic flux measurement may include filtering the measurement to remove noise, avoid aliasing, and ADC saturation and converting the measurement from analog to digital, and recovery of the digital data form the AC carrier.

The output measurement may be in digital form. More particularly, the output measurement may be or include the digital telemetry frame. In one embodiment, the telemetry frame may be in the following form: frame identification, data 1, data 2, data 3, data 4, data 5, data 6, checksum, end of frame pattern. Data 1 may be the magnetic flux measurement from the sensor 150, data 2 may be a magnetic flux measurement from another sensor, data 3 may be a downhole temperature measurement, data 4 may be a downhole voltage fed to the power supply, data 5 may be an error check performed by the ADC, and data 6 may be the time when the magnetic flux measurements were acquired.

The method 1300 may also include transmitting the recovered digital frame to a computer system 102 at the surface location 100, as at 1316. This transmission may be done via a wire or cable 314 in the wellbore 110 (e.g., in the cement surrounding the casing 116. The computer system 102 at the surface location 100 may receive the output measurement (e.g., telemetry frame), verify the validity of the frames, and decode the frames into digital words to recover the data (e.g., the property measured at 1302) in the frames. The computer system 102 may also provide additional power to be transmitted downhole and/or transmit clock synchronization information downhole.

Figure 14:
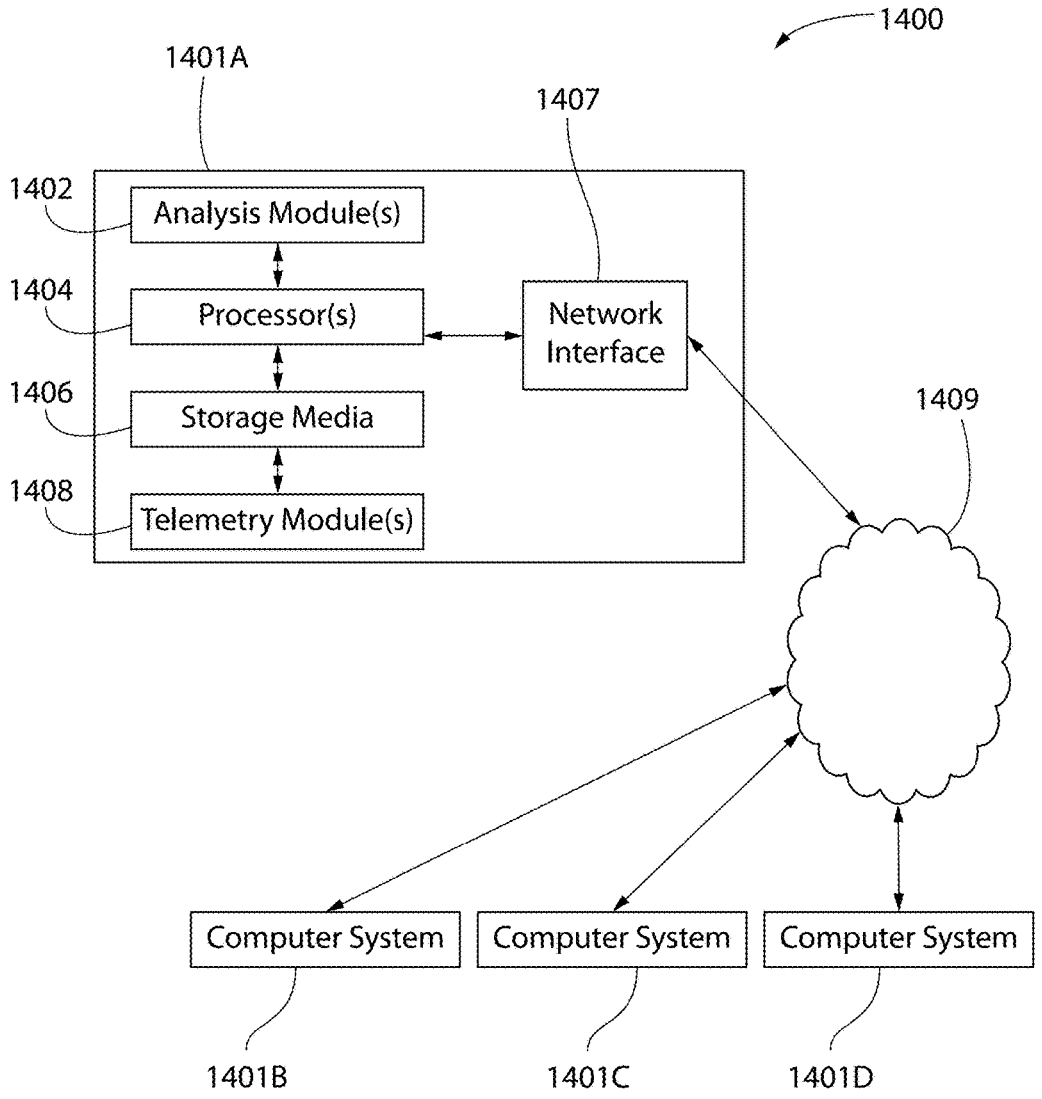
FIG. 14 illustrates a schematic view of a computing system, according to an embodiment.

In some embodiments, the methods of the present disclosure may be executed by a computing system. FIG. 14 illustrates an example of such a computing system 1400, in accordance with some embodiments. The computing system 1400 may include a computer or computer system 1401A, which may be an individual computer system 1401A or an arrangement of distributed computer systems. The computer system 1401A may be the computer system 102 at the surface location 100 or the downhole data re-transmitter 320 in the downhole tool 130. The computer system 1401A includes one or more analysis modules 1402 that are configured to perform various tasks according to some embodiments, such as one or more methods disclosed herein. To perform these various tasks, the analysis module 1402 executes independently, or in coordination with, one or more processors 1404, which is (or are) connected to one or more storage media 1406. The processor(s) 1404 is (or are) also connected to a network interface 1407 to allow the computer system 1401A to communicate over a data network 1409 with one or more additional computer systems and/or computing systems, such as 1401B, 1401C, and/or 1401D (note that computer systems 1401B, 1401C and/or 1401D may or may not share the same architecture as computer system 1401A, and may be located in different physical locations, e.g., computer systems 1401A and 1401B may be located in a processing facility, while in communication with one or more computer systems such as 1401C and/or 1401D that are located in one or more data centers, and/or located in varying countries on different continents). The computer system 1401B may be the computer system 102 at the surface location 100 or the downhole data re-transmitter 320 in the downhole tool 130.

A processor may include a microprocessor, microcontroller, processor module or subsystem, programmable integrated circuit, programmable gate array, or another control or computing device.

The storage media 1406 may be implemented as one or more computer-readable or machine-readable storage media. Note that while in the example embodiment of FIG. 14 storage media 1406 is depicted as within computer system 1401A, in some embodiments, storage media 1406 may be distributed within and/or across multiple internal and/or external enclosures of computing system 1401A and/or additional computing systems. Storage media 1406 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 1400 contains one or more telemetry module(s) 1408. In the example of computing system 1400, computer system 1401A includes the telemetry module 1408. In some embodiments, a single telemetry module may be used to perform one or more embodiments of the method 1300 disclosed herein. In other embodiments, a plurality of telemetry modules may be used to perform the method 1300 herein.

It should be appreciated that computing system 1400 is only one example of a computing system, and that computing system 1400 may have more or fewer components than shown, may combine additional components not depicted in the example embodiment of FIG. 14, and/or computing system 1400 may have a different configuration or arrangement of the components depicted in FIG. 14. The various components shown in FIG. 14 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A method for transmitting data from a downhole tool in a wellbore to a surface location, comprising:

measuring a property in a wellbore using a downhole tool in the wellbore, wherein a casing is positioned within the wellbore, and wherein the downhole tool is positioned below at least a portion of the casing;

generating a digital frame, using the downhole tool, wherein the digital frame includes information corresponding to the property;

encoding the digital frame to superpose the information on a carrier signal;

converting the carrier signal to a voltage differential that is generated across an insulation layer in the downhole tool, wherein the voltage differential causes a current to flow through a subterranean formation and into the casing above the downhole tool; and detecting a magnetic flux generated by the current flowing through the casing using a sensor that is positioned at least partially within or at least partially around the casing.

2. The method of claim 1, wherein the property comprises a physical property or a formation property.

3. The method of claim 1, wherein the downhole tool is coupled to a drill string, and wherein a portion of the current flows through the drill string.

4. The method of claim 1, wherein the casing comprises a casing shoe, and wherein the sensor is positioned at least partially within or at least partially around the casing shoe.

5. The method of claim 4, wherein the sensor comprises an annular ferromagnetic body having a wire wrapped around at least a portion of a circumference thereof.

6. The method of claim 1, wherein the sensor is positioned at least partially within a first circumferential pocket in the casing or in a casing shoe coupled to the casing.

7. The method of claim 6, wherein the sensor comprises an annular ferromagnetic body having a wire wrapped around at least a portion of a circumference thereof, wherein an outer radial wall defining the first circumferential pocket defines an axial gap that causes the current to flow through a portion of the casing or the casing shoe that is positioned radially-inward from the sensor.

8. The method of claim 7, wherein a processor is positioned at least partially within a second pocket in the casing or in the casing shoe, and wherein the processor is configured to recover the digital frame from an output of the sensor.

9. The method of claim 8, further comprising transmitting the digital frame from the processor to a surface location using a cable in the wellbore.

10. The method of claim 1, wherein the sensor comprises a magnetometer.

11. A method for transmitting data from a downhole tool in a wellbore to a surface location, comprising:

running a downhole tool into a first wellbore;

measuring a property using the downhole tool in the first wellbore;

generating a digital frame, using the downhole tool, wherein the digital frame includes information corresponding to the property;

encoding the digital frame to superpose the information on a carrier signal;

converting the carrier signal to a voltage differential that is generated across an insulation layer in the downhole tool, wherein the voltage differential causes a current to flow through a subterranean formation and into a casing in a second wellbore; and detecting a magnetic flux generated by the current flowing through the casing in the second wellbore using a sensor that is positioned in a bore defined by the casing, in the casing, in a casing shoe that is coupled to the casing, outside of the casing, or outside of the casing shoe.

12. The method of claim 11, further comprising transmitting the digital frame from the sensor to a surface location using a cable in the wellbore.

13. The method of claim 11, wherein the sensor is positioned at least partially within a first circumferential pocket, and wherein the first circumferential pocket is defined in the casing or in the casing shoe.

14. The method of claim 13, wherein the sensor comprises an annular ferromagnetic body having a wire wrapped around at least a portion of a circumference thereof, wherein an outer radial wall defining the first circumferential pocket defines an axial gap that causes the current to flow through a portion of the casing or the casing shoe that is positioned radially-inward from the sensor.

15. The method of claim 11, wherein the sensor comprises a magnetometer installed outside of the casing.

16. The method of claim 11, wherein the sensor comprises a body having a first arm in contact with the casing and a second arm in contact with the casing, wherein the first and second arms are axially-offset from one another.

17. The method of claim 16, wherein the first arm comprises a first electrode in contact with the casing and a first insulation layer positioned between the first electrode and the body, wherein the second arm comprises a second electrode in contact with the casing and a second insulation layer positioned between the second electrode and the body, and wherein the first and second electrodes measure a difference in voltage between the first and second electrodes.

18. The method of claim 11, further comprising lowering the sensor into the bore of the casing on a wireline cable.

19. The method of claim 11, wherein the sensor is positioned below a layer of the subterranean formation that has a resistivity that is less than or equal to 1 Ωm or greater than or equal to 1000 Ωm.

20. A method for transmitting data from a downhole tool in a wellbore to a surface location, comprising:

running a downhole tool into a first wellbore;

measuring a property using the downhole tool in the first wellbore;

generating a digital frame, using the downhole tool, wherein the digital frame includes information corresponding to the property;

encoding the digital frame to superpose the information on a carrier signal;

converting the carrier signal to a voltage differential that is generated across an insulation layer in the downhole tool, wherein the voltage differential causes a current to flow through a subterranean formation; and detecting a magnetic flux generated by the current using a sensor that is positioned in a second wellbore that deviates from the first wellbore.

21. A method for transmitting data from a downhole tool in a main wellbore to a surface location, comprising:

running a downhole tool into a first wellbore having a first casing positioned therein;

measuring a property using the downhole tool in the first wellbore;

generating a digital frame, using the downhole tool, wherein the digital frame includes information corresponding to the property;

encoding the digital frame to superpose the information on a carrier signal;

converting the carrier signal to a voltage differential that is generated across an insulation layer in the downhole tool, wherein the voltage differential causes a current to flow through a subterranean formation and into a second casing in a second wellbore;

detecting a magnetic flux generated by the current flowing through the second casing using a sensor that is positioned at least partially within or at least partially around the second casing;

transmitting data detected by the sensor to a receiver positioned in or around the first casing in the first wellbore; and transmitting the data from the receiver to a computer at a surface location using a cable positioned radially-outward from the first casing in the first wellbore.

22. A system for transmitting data from a downhole tool in a wellbore to a surface location, comprising:

a downhole tool configured to:

measure a property in a wellbore;

generate a digital frame including information corresponding to the property;

encode the digital frame to superpose the information on a carrier signal; and convert the carrier signal to a voltage differential that is generated across an insulation layer in the downhole tool, wherein the voltage differential causes a current to flow through a subterranean formation and into a casing above the downhole tool; and a sensor positioned at least partially within or at least partially around the casing, wherein the sensor is configured to detect a magnetic flux generated by the current flowing through the casing.

23. The system of claim 22, wherein the downhole tool comprises a first computer system positioned therein, wherein the first computer system is configured to generate the digital frame.

24. The system of claim 22, wherein the casing comprises a casing shoe, and wherein the casing shoe defines a circumferential pocket having the sensor positioned therein.

25. The system of claim 24, wherein an outer radial wall defining the circumferential pocket defines an axial gap that causes the current to flow through a portion of the casing shoe that is positioned radially-inward from the sensor.

* * * * *